US009149940B2

(12) United States Patent
Hao

(10) Patent No.: US 9,149,940 B2
(45) Date of Patent: Oct. 6, 2015

(54) SIDE BLADE LOCK AND RELEASE MECHANISM FOR USE WITH A KNIFE

(75) Inventor: Wen Hao, City of Industry, CA (US)

(73) Assignee: JPJ Investment Holding Corp., City of Industry, CA (US)

( * ) Notice: Subject to any disclaimer, the term of this patent is extended or adjusted under 35 U.S.C. 154(b) by 528 days.

(21) Appl. No.: 12/841,773

(22) Filed: Jul. 22, 2010

(65) Prior Publication Data

US 2012/0017443 A1 Jan. 26, 2012

(51) Int. Cl.

| | |
|---|---|
| ***B26B 1/02*** | (2006.01) |
| ***B26B 1/04*** | (2006.01) |
| ***B26B 1/06*** | (2006.01) |
| ***B26B 1/00*** | (2006.01) |

(52) U.S. Cl.

CPC ... *B26B 1/04* (2013.01); *B26B 1/00* (2013.01); *B26B 1/02* (2013.01); *B26B 1/046* (2013.01); *B26B 1/06* (2013.01); *B26B 1/044* (2013.01); *B26B 1/048* (2013.01)

(58) Field of Classification Search

CPC ..... B26B 1/00; B26B 1/02; B26B 1/04; B26B 1/046; B26B 1/044; B26B 1/048

USPC ..... 30/151, 153, 154, 155, 158, 159, 160, 30/161

See application file for complete search history.

(56) References Cited

U.S. PATENT DOCUMENTS

| | | | | |
|---|---|---|---|---|
| 2,617,187 | A * | 11/1952 | Hopta | 30/161 |
| 4,347,665 | A | 9/1982 | Glesser | |
| 4,897,922 | A * | 2/1990 | Brooker | 30/161 |
| 5,095,624 | A | 3/1992 | Ennis | |
| 5,325,588 | A * | 7/1994 | Rogers | 30/161 |
| 5,596,808 | A * | 1/1997 | Lake et al. | 30/161 |
| D437,767 | S | 2/2001 | Van Deursen | |
| 6,363,615 | B1 * | 4/2002 | Moser | 30/161 |
| 6,915,577 | B2 | 7/2005 | Scala | |
| D509,724 | S | 9/2005 | Cook | |
| 6,957,491 | B2 | 10/2005 | Van Deursen et al. | |
| 7,003,833 | B2 | 2/2006 | Feliciano | |
| 7,305,768 | B2 * | 12/2007 | Hinderer | 30/161 |
| 2003/0150116 | A1 | 8/2003 | Scala | |
| 2005/0044717 | A1 * | 3/2005 | Nishihara | 30/161 |
| 2005/0204567 | A1 | 9/2005 | Ping | |
| 2007/0006466 | A1 | 1/2007 | Ping | |
| 2007/0130777 | A1 | 6/2007 | Ping | |

* cited by examiner

*Primary Examiner* — Kenneth E. Peterson
*Assistant Examiner* — Jennifer Swinney
(74) *Attorney, Agent, or Firm* — Patterson & Sheridan, LLP

(57) ABSTRACT

A knife is provided. The knife comprises a handle and a blade configured to pivot with respect to the handle between an open position wherein a cutting edge of the blade is exposed and a closed position wherein the cutting edge of the blade is disposed within the handle, the blade including an abutting surface. The knife may further comprise a locking assembly configured to releasably lock the blade in the open position, the locking assembly comprising a biased, rotatable member having a canted surface for engaging a corresponding surface on the blade, wherein the canted surface and the corresponding surface are configured to secure the blade relative to the handle in the open position.

14 Claims, 7 Drawing Sheets

SIDE BLADE LOCK AND RELEASE MECHANISM FOR USE WITH A KNIFE

BACKGROUND OF THE INVENTION

1. Field of the Invention

Embodiments of the present invention generally relate to hand tools, and more specifically to a folding knife having a blade lock and release mechanism.

2. Description of the Related Art

Conventional folding knives have various locks for locking the blade in the open position. For example, a conventional "lock back" style of folding knife provides for the blade to be locked in the open position, and the blade is released by depressing a lever into a cutout in the rear of the handle. However, this arrangement requires substantial repositioning of the entire knife in the user's hand in order to provide access and leverage for depressing the lever.

Furthermore, conventional folding knives do not necessarily lock the blade in the closed position. Thus, the knife may inadvertently open at inopportune times, presenting a hazard to the user.

SUMMARY OF THE INVENTION

According to aspects of the present invention, a knife is provided. The knife comprises a handle and a blade configured to pivot with respect to the handle between an open position wherein a cutting edge of the blade is exposed and a closed position wherein the cutting edge of the blade is disposed within the handle, the blade including an abutting surface. The knife may further comprise a locking assembly configured to releasably lock the blade in the open position, the locking assembly comprising a biased, rotatable member having a canted surface for engaging a corresponding surface on the blade, wherein the canted surface and the corresponding surface are configured to secure the blade relative to the handle in the open position.

According to another aspect of the present invention, a knife is provided. The knife may comprise a handle having a first side and a second side and a blade disposed between the first and second sides and pivotally movable relative to the handle between an open position and a closed position. The knife may further comprise a locking assembly for releasably locking the blade in the open position, the locking assembly comprising a rotatable member having a gripping portion accessible via an aperture in one side of the handle and a canted surface for engagement with the blade, and wherein the rotatable member is pivotally movable with respect to the handle between a locked position and an unlocked position.

According to another aspect of the present invention, a knife is provided. The knife may comprise a handle having a first side and a second side and a blade disposed between the first and second sides and pivotally movable relative to the handle between an open position and a closed position. The knife may further comprise a locking means for releasably locking the blade in the open position and in the closed position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
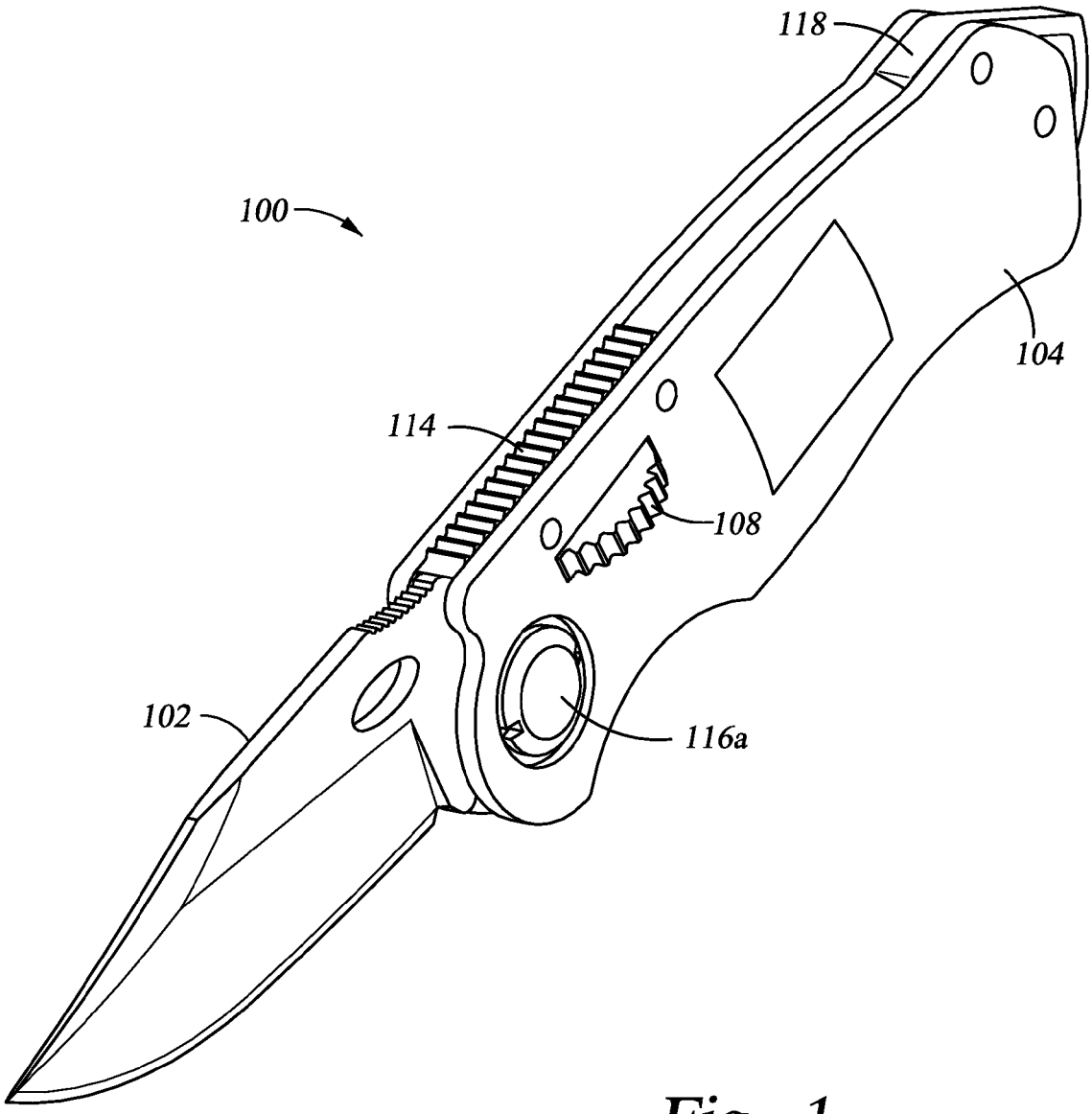
FIG. 1 is a perspective view of a folding knife according to certain embodiments of the present invention.

Referring specifically to the Figures in which identical or similar parts as designated by the same reference numerals throughout, and further referring to FIG. 1, the folding knife in accordance with the present invention is generally designated by reference numeral 100.

Figure 2:
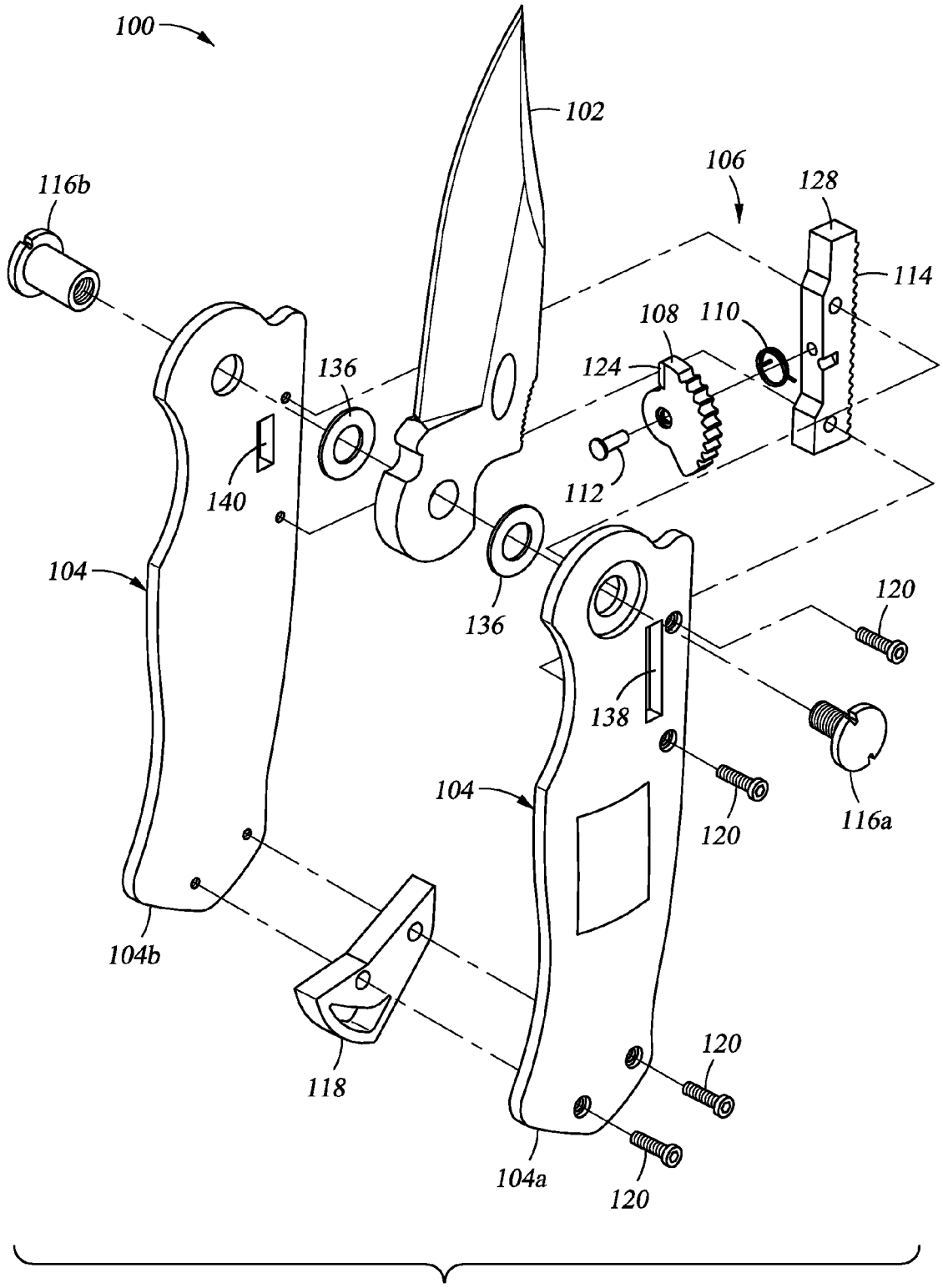
FIG. 2 illustrates an exploded view of a folding knife according to certain embodiments of the present invention.

FIG. 1 is a perspective view of the folding knife 100 according to certain embodiments to the present invention. FIG. 2 is an exploded view of the folding knife 100. Folding knife 100 includes blade 102, which is pivotally mounted to handle 104*a, b*, locking assembly 106 for retaining the blade in an open and closed position, interconnecting bolt 116*a* and mating interconnecting nut 116*b* for maintaining the blade in the handle, rear support 118, fasteners 120, and gaskets 136.

The handle 104 may be comprised of two parts 104*a, b* as shown. Locking assembly 106 is mounted with the handle 104 for locking the blade 102 in an open position, as shown in FIG. 1, and closed position. Lock support 114 (which is part of locking assembly 106) and rear support 118 are disposed between two parts of the handle 104. The space between the two parts 104*a, b* of the handle 104 due to lock support 114 and rear support 118 allow for pivoting end of the blade 102 to be located within the handle. In alternative embodiments, the handle 104 may be comprised of a single part forming both sides of the knife 100, with the locking assembly 106 integrated into the handle 104 with fasteners 120.

As seen in FIG. 2, folding knife 100 includes locking assembly 106. Locking assembly 106 comprises a rotatable member 108, coiled spring 110, pivot pin 112, and lock support 114. Pivot pin 112 attaches the rotatable member 108 to the lock support 114 and allows rotatable member 108 to rotate with respect to lock support 114. Coiled spring 110 is disposed between the rotatable member 108 and lock support 114 so that rotatable member 108 is rotationally biased with respect to lock support 114. For example, the coiled spring 110 may rotationally bias the rotatable member in the direction indicated by arrow 144 in FIGS. 5 and 6. According to alternative embodiments, the biasing force could be provided from a suitable structure other than coiled spring 110, such as a flexible member or a compressible member, for example.

Figure 7:
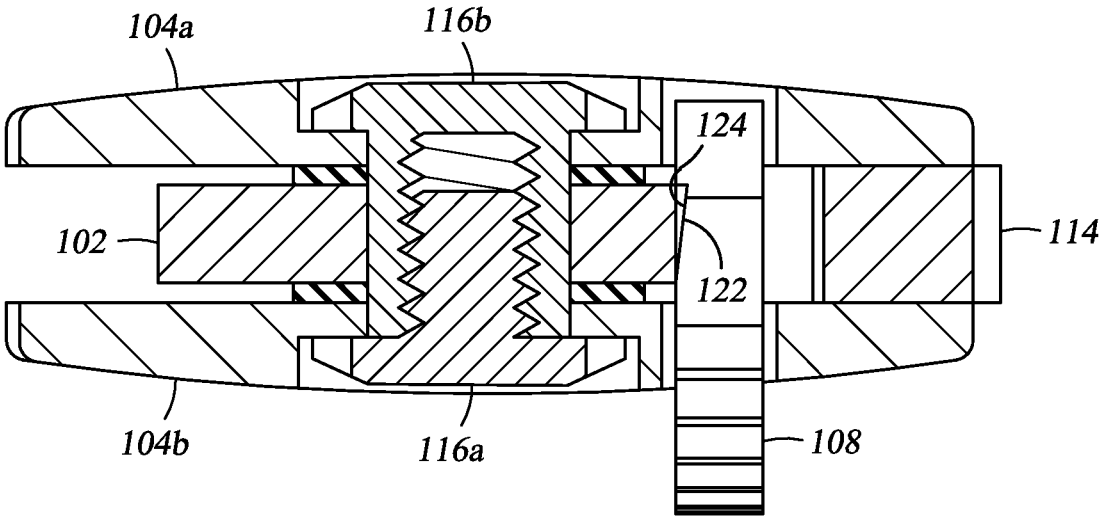
FIG. 7 illustrates a cross section view of a folding knife with the blade in an open, locked position, according to certain embodiments of the present invention.

The lock support 114 is disposed between the two portions of the handle 104*a, b* and connected thereto with fasteners 120. Lock support 114 may include a gripping portion to improve a user's grip on the folding knife 100. In the embodiment shown, rotatable member 108 includes serrations on one side to enable a user to apply a force to overcome the bias due to coiled spring 110. The serrations are arranged to protrude from the inside of the handle 104 through a large aperture 138 formed in the handle part 104*a* so that a user can apply a force against the biasing force of coiled spring 110 from the exterior of the folding knife 100. The portion of the rotatable member 108 opposite the serrations extends into a small aperture 140 formed in handle part 104*b*. However, the portion of the rotatable member 108 opposite the gripping portion may not protrude entirely through the small aperture 140. For example, as can be seen in FIG. 7, discussed further below, the rotatable member 108 does not extend to the exterior of handle portion 104*b*.

Interconnecting bolt 116*a* connects through the handle 104, gaskets 136, and blade 102, with interconnecting nut 116*b* to hold the blade 102 in pivoting arrangement to handle 104. Gaskets 136 may provide for smooth pivoting movement of the blade 102 with respect to handle 104 and are therefore made of a suitable material such as durable plastic, rubber, silicon or the like. Rear support 118 is disposed between the two halves of the handle 104 with fasteners 120.

Figure 3:
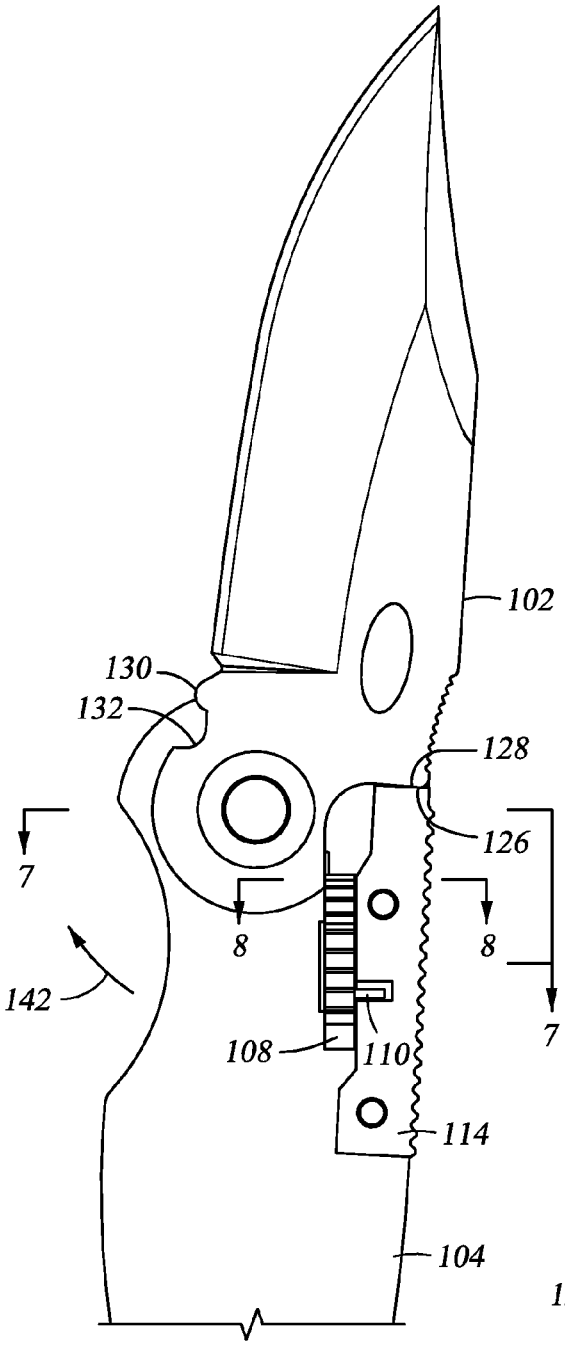
FIG. 3 illustrates a partial view of a folding knife with the blade in an open, locked position, according to certain embodiments of the present invention.

FIG. 3 is a partial view of the folding knife 100 according to aspects of the present invention, in which blade 102 is locked in an open locked position by the locking assembly 106. In FIG. 3, one side of the handle 104 has been omitted to illustrate the arrangement between the blade 102 and locking assembly 106. A blade stop surface 126 on the blade 102 abuts a lock support stop surface 128 on the lock support 114, thus preventing the blade from rotating any further in an open direction. The biasing force of coiled spring 110 urges the rotatable member into the open locked position, which in turn, urges the blade 102 in the direction indicated by the arrow 142 in FIG. 3, so that blade stop surface 126 is firmly urged against lock support stop surface 128. This arrangement provides for a more secure locked position for the blade in the open position with respect to the handle.

Figure 4:
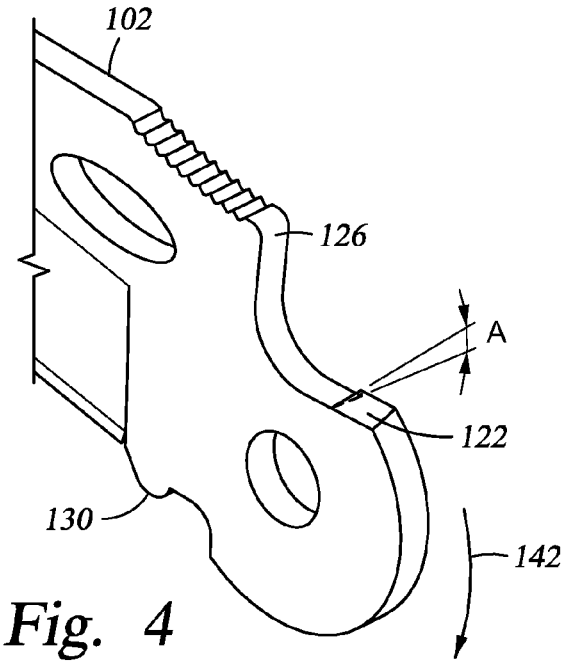
FIG. 4 illustrates a pivoting end of a blade of a folding knife according to certain embodiments of the present invention.
Figure 5:
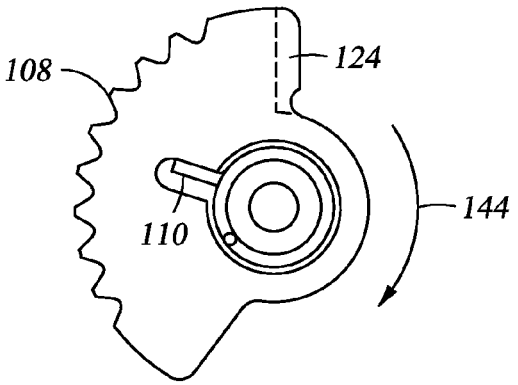
FIG. 5 illustrates a side view of a rotatable member for locking the blade of a folding knife according to certain embodiments of the present invention.
Figure 6:
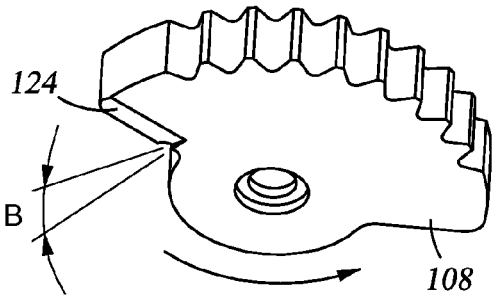
FIG. 6 illustrates a perspective view of a rotatable member for locking the blade of a folding knife according to certain embodiments of the present invention.

As shown in FIG. 4, blade 102 includes a canted blade surface 122 having an angle A relative to the thickness of the blade 102. As shown in FIGS. 5 and 6, rotatable member 108 includes a corresponding canted blade lock surface 124. Canted blade lock surface 124 has an angle B relative to the plane perpendicular to the thickness of rotatable member 108. The coil spring 144 biases the rotatable member 108 in the direction of arrow 144 shown in FIG. 5.

FIG. 7 is a cross-section of folding knife 100 viewed from a plane perpendicular to the length of the folding knife 100 through the point at interconnecting bolt 116*a* and interconnecting nut 116*b*, and illustrates the locking arrangement between the blade 102 and the locking assembly 106 when the blade is in the open locked position. In FIG. 7, the canted blade lock surface 124 (having an angle B) of rotatable member 108 is disposed against canted blade surface 122 (having an angle A) of blade 102. Rotatable member 108 is biased against blade 102 due to the force from coiled spring 110 (not shown in FIG. 7). Due to their geometry, the canted blade surface 122 is biased against the canted blade lock surface 124, urging the blade 102 in the open direction. Blade stop surface 126 prevents the blade from opening further due to its abutment to lock support stop surface 128, as illustrated in FIG. 3.

The tension created by coiled spring 110 biasing the rotatable member 108 into the position shown in FIG. 7 creates tension that causes the blade to remain in a locked and secured, immobile position relative to the handle 104. This immovable arrangement is due to the interaction of canted blade lock surface 124 with the canted blade surface 122 of blade 102, and keeps the blade secured in the locked position even as components may be worn over time, and without requiring excessively precise manufacturing tolerance.

Figure 8:
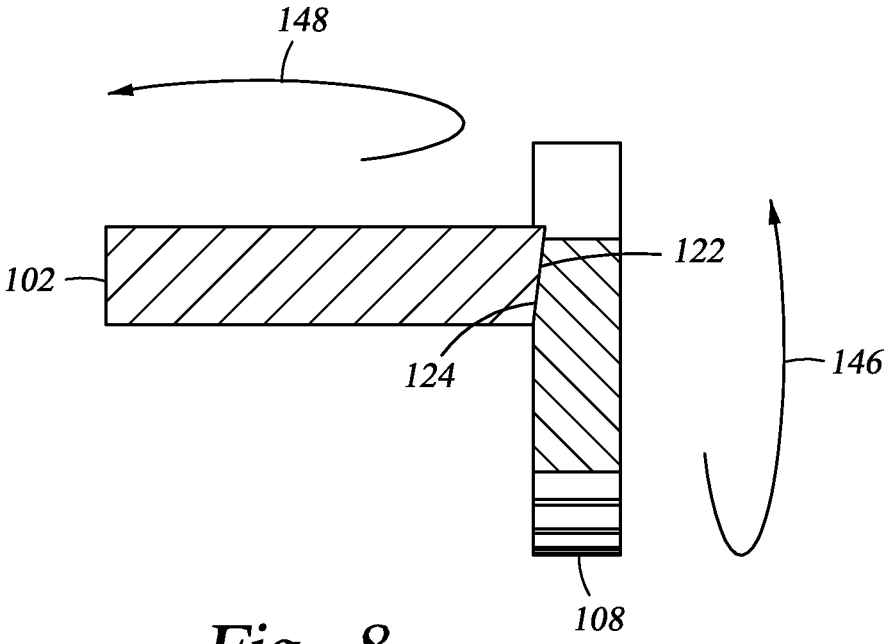
FIG. 8 illustrates a cross section view of a rotatable member and a blade of a folding knife in an opened, locked position, according to certain embodiments of the present invention.

FIG. 8 also illustrates the arrangement between rotatable member 108 and blade 102 in the open, locked position. As indicated by the arrow 146, the rotatable member 108 is urged towards the locking position due to the biasing action of coiled spring 110. This urges the blade 102 to rotate as indicated by the arrow 148 into the open position, while rotation is stopped in the open locked position due to the blade stop surface 126 abutting lock support stop surface 128.

Figure 9:
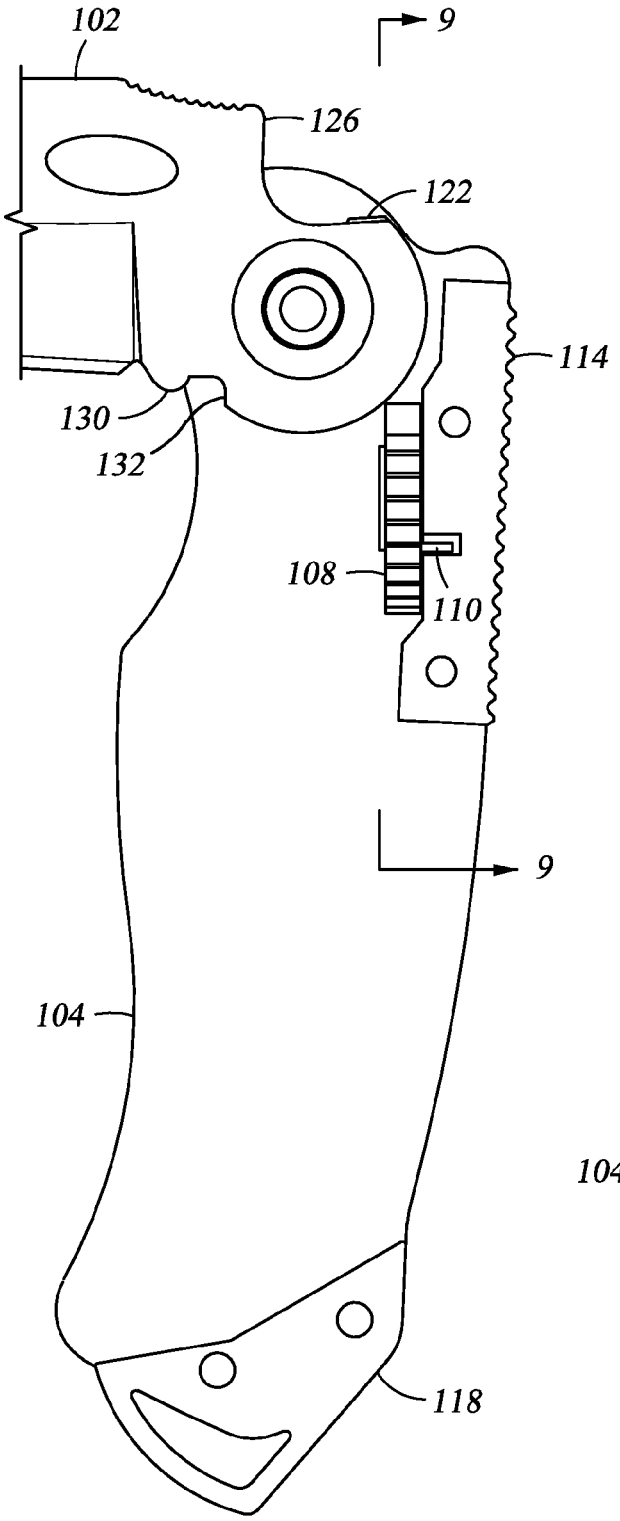
FIG. 9 illustrates a partial view of a folding knife with the blade in a pivoting, unlocked position, according to certain embodiments of the present invention.

FIG. 9 illustrates the blade 102 in the unlocked, pivoting position in which the blade 102 in a partially open position and free to pivot with respect to the handle 104. In order to move the blade 102 from the locked position, as shown in FIG. 3, to the unlocked, partially open position shown in FIG. 9, the user rotates rotatable member 108 against the biasing force of coiled spring 110 so that the canted blade lock surface 124 is no longer engaged with canted blade surface 122. Rotatable member 108 may be disposed on one side of the blade handle (rather than the top, for instance), so that it can be readily moved from the locked to the unlocked, partially open position with a user's thumb. Thus, according to some embodiments, the rotatable member 108 and the large aperture 138 may be located in an ergonomic position with respect to the handle 104 for ease of safe engagement by a user. In alternative embodiments, the rotatable member 108 and large aperture 138 may be located on a side of the handle suitable for ease of use by a left-handed user.

Figure 10:
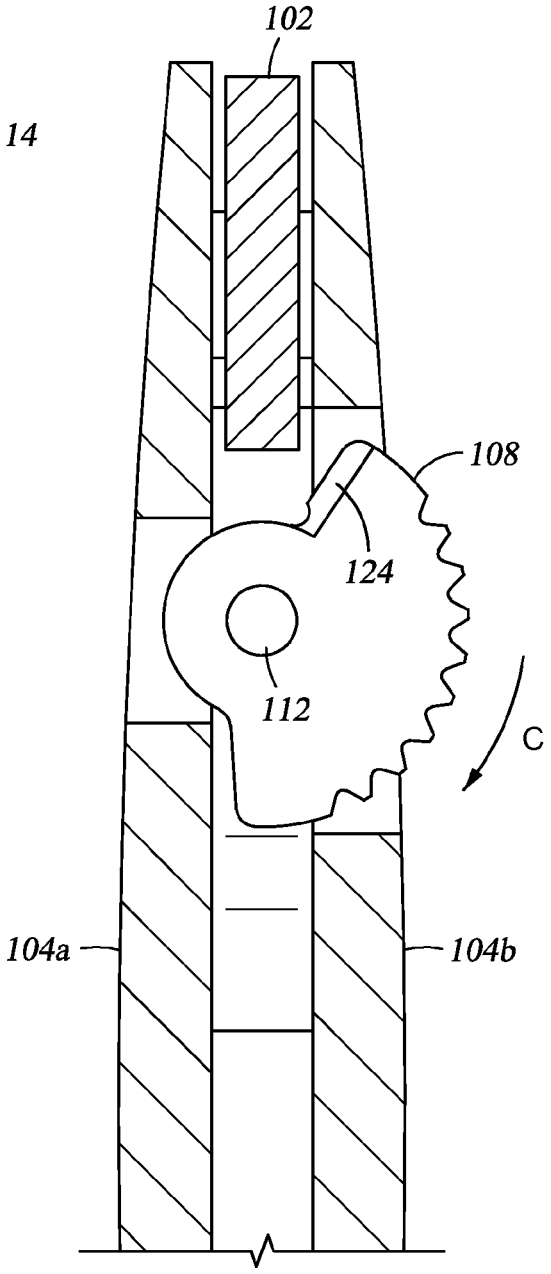
FIG. 10 illustrates cut away view of a folding knife with the blade in a pivoting, unlocked position, according to certain embodiments of the present invention.

FIG. 10 is a cross section view illustrating this unlocked, partially open position of the rotatable member 108. In some embodiments, the user must continue to overcome the biasing force of coiled spring 110 to allow the blade to freely pivot in the range between the two locked positions. In other embodiments, blade 102 may be free to pivot even if the user is not overcoming the biasing force of coiled spring 110. In other words, the biasing force of coiled spring 110 urges the rotatable member 108 against the blade 102, but without excessive force that would prevent blade 102 from pivoting with respect to handle 104. Thus, the canted blade lock surface 124 of rotatable member 108 is urged against the blade 102 without locking the blade 102 as the blade pivots so long as the blade is not pivoted to the open or closed locked position, i.e., into engagement with canted blade surface 122 or blade lock detent 122.

Figure 11:
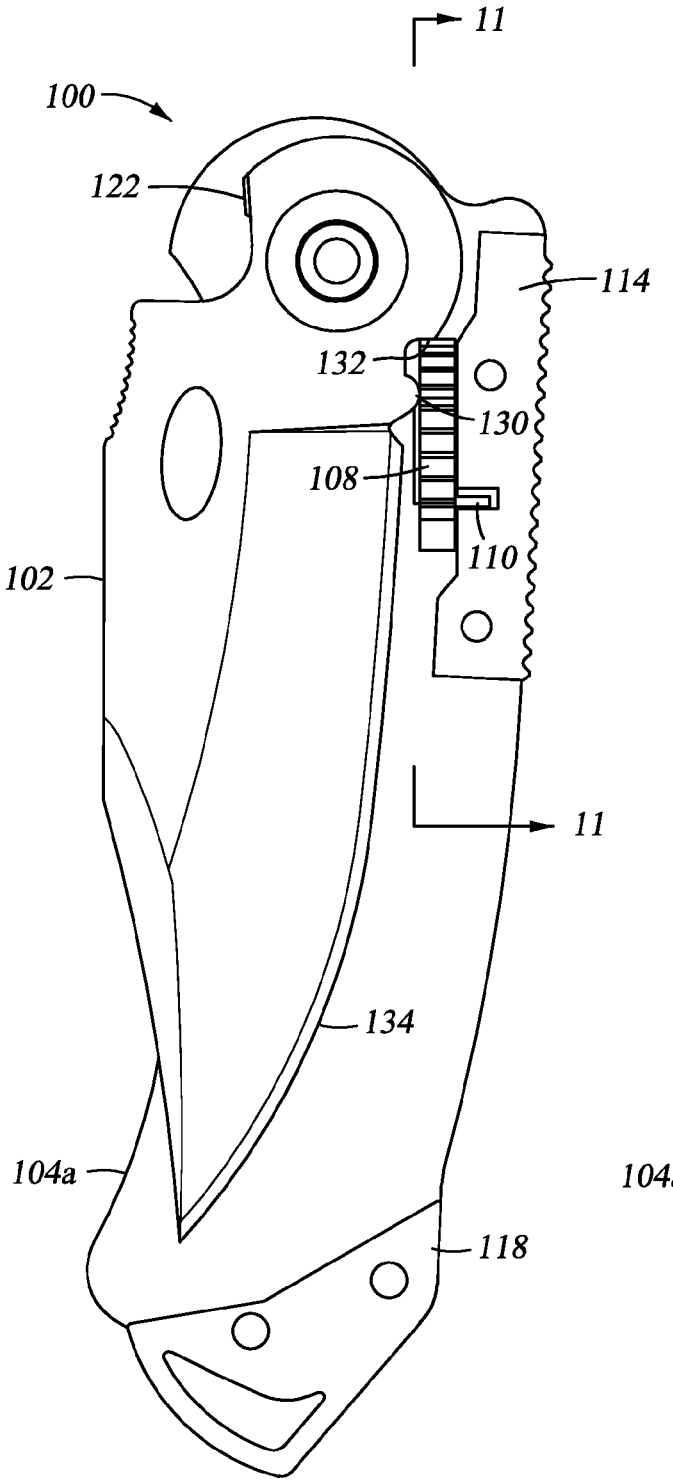
FIG. 11 illustrates a partial view of a folding knife with the blade in a closed, locked position, according to certain embodiments of the present invention.
Figure 12:
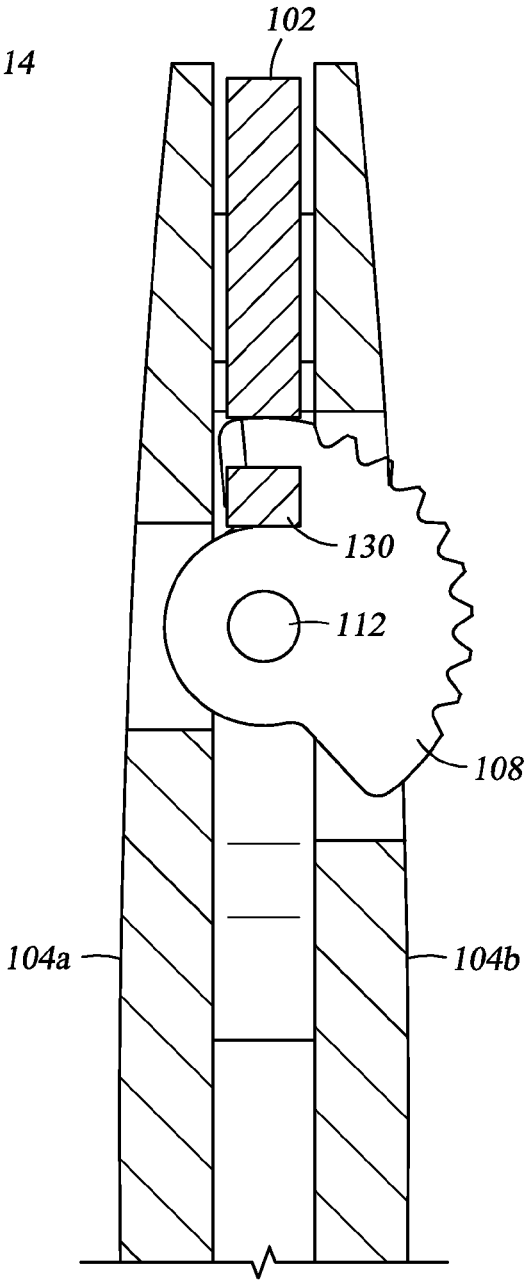
FIG. 12 illustrates cut away view of a folding knife with the blade in a closed, locked position, according to certain embodiments of the present invention.

FIGS. 11 and 12 illustrate the folding knife 100 in the closed locked position. If the biasing force of coiled spring 110 is not overcome, rotatable member 108 is urged towards the locked position. When the blade 102 pivots all the way to the closed position shown in FIG. 11, coiled spring 110 urges canted blade lock surface 124 of rotatable member 108 into the blade stop detent 132 of blade 102. This locks the blade in the closed locked position, and the user must overcome the biasing force of coiled spring 110 on rotatable member 108 in order to unlock and open the blade. When the user overcomes the biasing force of coiled spring 110 and moves the rotatable member 108 out of the locked position, the blade is free to pivot between the closed and open positions, as shown in FIG. 10. In the embodiments shown, there is no blade lock position on the blade 102 between the open locked position and the closed lock position.

Blade stop knob 130 prevents the blade 102 from pivoting further into handle 104, thus preventing blade edge 134 from contacting the inner components inside the handle 104, such as rotatable member 108 or lock support 114, for example. This prevents the blade edge 134 from being unnecessarily dulled or damaged as it is moved to the closed, locked position or while the folding knife 100 is carried in the closed, locked position.

FIG. 12 is a cross section view of the folding knife 100 in the closed locked position. Rotatable member 108 is biased in the counterclockwise direction in the locked position due to the force from coiled spring 110. The rotatable member 108 is disposed in blade stop detent 132 and prevents the blade 102 from opening. Blade stop knob 130 abuts rotatable member 108, thereby preventing the blade 102 from pivoting further into the handle, thereby protecting blade edge 134, as discussed above.

In the figures, blade 102 is depicted as a sporting-type blade. However, the blade 102 could be any suitable type of blade, such as a saw blade or a tanto-type blade, for example.

Figure 13:
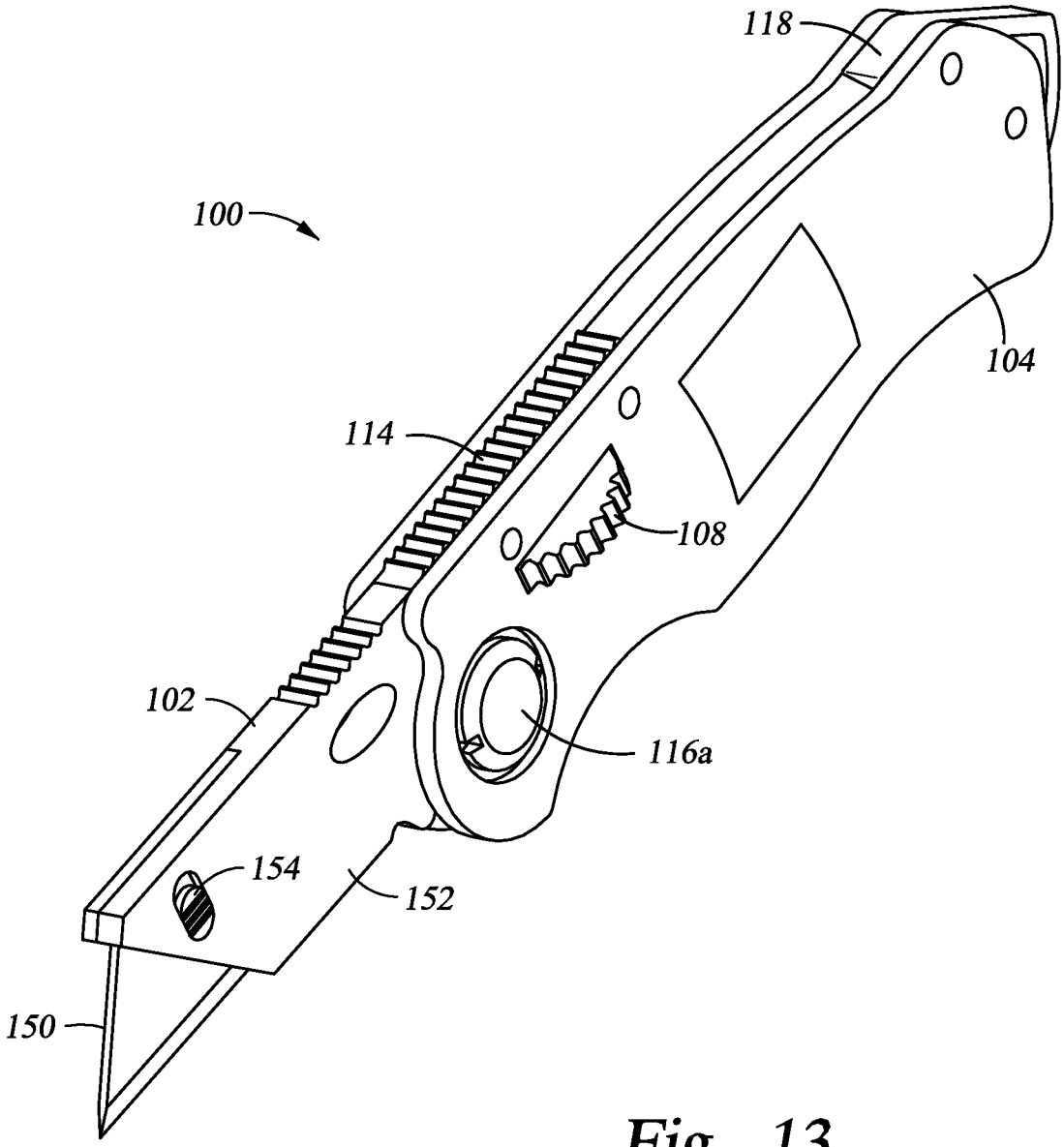
FIG. 13 illustrates a perspective view of a folding knife according to an alternative embodiment of the present invention.

Another example is shown in FIG. 13. The blade 102 may be a utility blade 150 mounted in a blade carrier 152. In the arrangement shown in FIG. 13, the utility blade and corresponding blade carrier pivot together with respect to the handle 104. A blade release member 154 is biased to releasably lock the utility blade 150 to the blade carrier 152. In the biased, locked position, the blade release member 145 engages a mounting notch (not shown) in the utility blade 150. A user may overcome the biasing force so that the blade release member 145 no longer engages the mounting notch in the utility blade 150, thereby allowing the blade 150 to be easily removed and replaced from the front of the blade carrier 152. The biasing force on blade release member 154 may be provided by a spring or other suitable biasing member. Other suitable blade lock mechanisms for releasably locking the utility blade 150 to the blade carrier 152 may be utilized without departing from the scope of the present invention. For example, a suitable blade lock mechanism for releasably locking a utility blade to a blade carrier is disclosed in U.S. Pat. No. 7,520,059, which is herein incorporated by reference.

While the foregoing is directed to embodiments of the present invention, other and further embodiments of the invention may be devised without departing from the basic scope thereof, and the scope thereof is determined by the claims that follow.

The invention claimed is:

1. A knife comprising:

a handle;

a blade configured to pivot with respect to the handle about a first axis between an open position wherein a cutting edge of the blade is exposed and a closed position wherein the cutting edge of the blade is disposed within the handle, the blade having a thickness and including a canted blade surface and an abutting surface, the canted blade surface defining a non-zero angle relative to the thickness of the blade; and a locking assembly configured to releasably lock the blade in the open position and in the closed position, the locking assembly comprising:

a biased, rotatable member having a canted blade lock surface configured to be disposed against the canted blade surface on the blade to lock the blade relative to the handle in the open position, wherein the rotatable member has a thickness and the canted blade lock surface defines a non-zero angle relative to a plane perpendicular to the thickness of the rotatable member; and a pivot pin disposed through the rotatable member, the pivot pin defining a second axis orthogonal to the first axis and perpendicular to a length of the handle, wherein the rotatable member rotates about the pivot pin between a first position with respect to the handle and a second position with respect to the handle, the rotatable member is in the first position when the blade is locked in the open position and in the closed position, the abutting surface on the blade abuts a lock stop surface fixed relative to the handle when the blade is in the open position, and the canted blade lock surface on the rotatable member is biased against the canted blade surface causing the abutting surface to be urged against the lock stop surface, when the blade is locked in the open position.

2. The knife according to claim 1 wherein the locking assembly is further configured to releasably lock the blade in the closed position.

3. The knife according to claim 2 wherein the rotatable member is configured to engage a detent in the blade to releasably lock the blade in the closed position.

4. The knife according to claim 3 wherein the canted blade lock surface is disposed on an engaging portion of the rotatable member and the engaging portion is configured to engage the detent in the blade when the blade is in the closed position.

5. The knife according to claim 1 wherein the rotatable member protrudes from one side of the handle.

6. The knife according to claim 1 wherein the blade is a sporting-type blade.

7. The knife according to claim 1 wherein the blade is a utility blade mounted in a blade carrier.

8. The knife of claim 1, further comprising a lock support attached to the handle, wherein the pivot pin is attached to the lock support, and the lock stop surface is formed on the lock support.

9. The knife of claim 8, wherein the handle comprises a first portion and a second portion, the lock support is disposed between the first portion and the second portion.

10. The knife of claim 8, wherein the lock support includes a gripping portion to improve a user's grip on the knife.

11. The knife of claim 8, wherein the locking assembly further comprises a bias member positioned between the rotatable member and the lock support to bias the rotatable member towards the first position.

12. The knife of claim 11, wherein the bias member is a coiled spring, a flexible member or a compressible member.

13. The knife of claim 1, wherein a portion of the rotatable member protrudes from one side of the handle to enable a user to apply a force to rotate the rotatable member from the first position to the second position.

14. The knife of claim 13, wherein the portion of the rotatable member protruding from the handle includes serrations.

* * * * *